US006471145B1

(12) United States Patent
Huang

(10) Patent No.: US 6,471,145 B1
(45) Date of Patent: Oct. 29, 2002

(54) CONTROL DEVICE OF A PISTOL NOZZLE OF A LAWN SPRINKLER

(76) Inventor: Huang-Fu Huang, No. 515, Chang-Nan Rd. Fen-Yuan Hsiang, Chang-Hua Hsien (TW)

( * ) Notice: Subject to any disclaimer, the term of this patent is extended or adjusted under 35 U.S.C. 154(b) by 0 days.

(21) Appl. No.: 10/059,064

(22) Filed: Jan. 30, 2002

(51) Int. Cl.[7] ..... B05B 7/02
(52) U.S. Cl. ..... 239/526; 239/525; 239/583
(58) Field of Search ..... 239/525, 526, 239/569, 583

(56) References Cited

U.S. PATENT DOCUMENTS 5,984,207 A * 11/1999 Wang ..... 318/478
6,129,294 A * 10/2000 Hsin-Fa ..... 239/293
6,352,212 B1 * 3/2002 Wang ..... 239/390

* cited by examiner

*Primary Examiner*—Cristopher Kim
(74) *Attorney, Agent, or Firm*—Harrison & Egbert

(57) ABSTRACT

A pistol nozzle of lawn sprinkler including a handle, a barrel, and a water control device. The handle is provided with a water admitting channel, whereas the barrel is provided with a water discharging channel. The water control device is disposed at the juncture of the water admitting channel and the water discharging channel. The water control device includes a valve rod which is provided with a piston to control the discharge of water by the barrel.

1 Claim, 11 Drawing Sheets

CONTROL DEVICE OF A PISTOL NOZZLE OF A LAWN SPRINKLER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a lawn sprinkler, and more particularly to a pistol nozzle control device of the lawn sprinkler.

BACKGROUND OF THE INVENTION

As shown in FIG. 1, a pistol nozzle of the prior art is provided with a control knob which is mounted in the front side of the handle of the pistol nozzle for starting and ending the watering of the pistol nozzle.

As shown in FIG. 2, another prior art pistol nozzle is provided with a control lever which is mounted in the back side of the handle of the pistol nozzle for starting and ending the watering of the pistol nozzle.

Both the control knob and the control lever of the prior art pistol nozzles are provided with a recovery force by a spring. For this reason, the act of watering of the prior art pistol nozzles persists only at the time when an external force exerting on the control knob or lever is greater than the recovery force of the control knob or lever. In other words, a user of the prior art pistol nozzles must keep pressing the control knob or lever while the prior art pistol nozzles are engaged in the act of watering. It is conceivably tiresome for the user of the pistol nozzle to keep pressing the control knob or lever. In addition, the control knob or lever is bound to confine the design versatility of the pistol nozzle. Moreover, the control lever of the prior art pistol nozzle is in fact a safety hazard in view of the fact that the palm of a user's hand is susceptible to injury by the control lever.

BRIEF SUMMARY OF THE INVENTION

The primary objective of the present invention is to provide a pistol nozzle with a water control device which is free of the deficiencies of the control devices of the prior art pistol nozzles described above.

In keeping with the principle of the present invention, the foregoing objective of the present invention is attained by a pistol nozzle comprising a water admitting channel, a water discharging channel, a receiving slot located at the juncture of the water admitting channel and the water discharging channel, and a water control device disposed in the receiving slot. The water control device comprises a valve rod for controlling the discharge of water.

The features and the advantages of the present invention will be more readily understood upon a thoughtful deliberation of the following detailed description of the present invention with reference to the accompanying drawings.

DETAILED DESCRIPTION OF THE INVENTION

Figure 1:
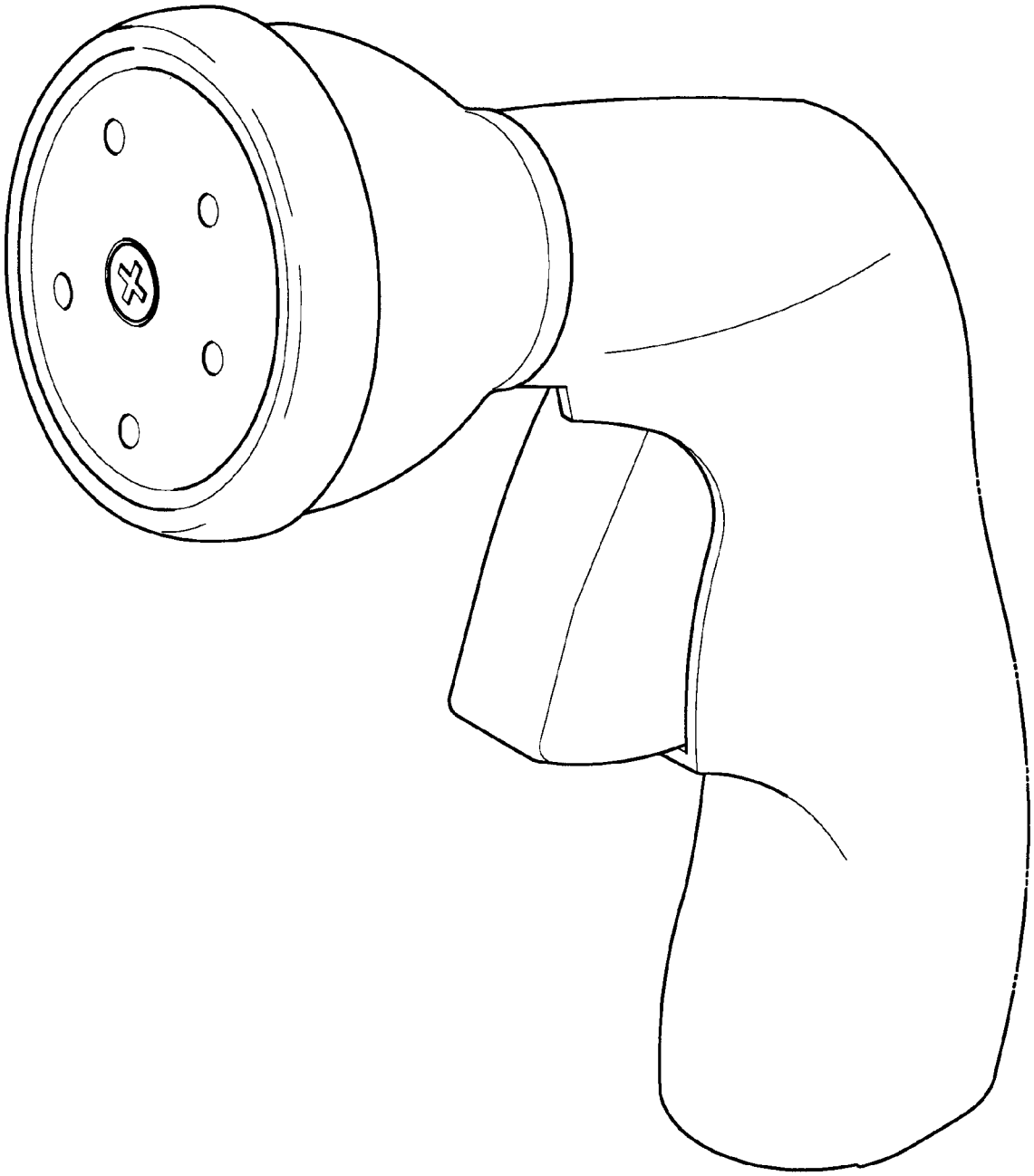
FIG.1 PRIOR ART
FIG. 1 shows a perspective view of a prior art pistol nozzle.
Figure 2:
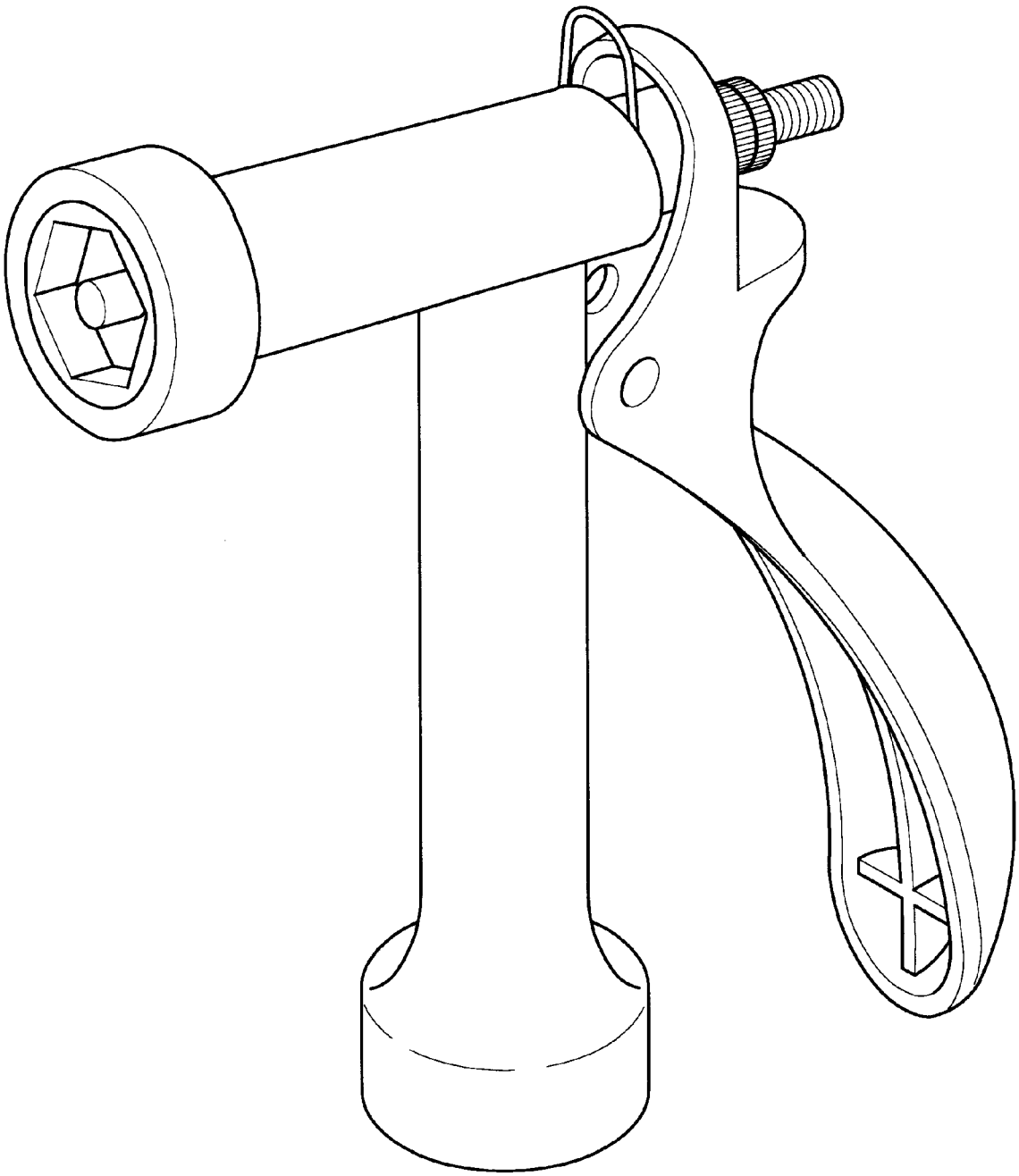
FIG.2 PRIOR ART
FIG. 2 shows a perspective view of another prior art pistol nozzle.
Figure 3:
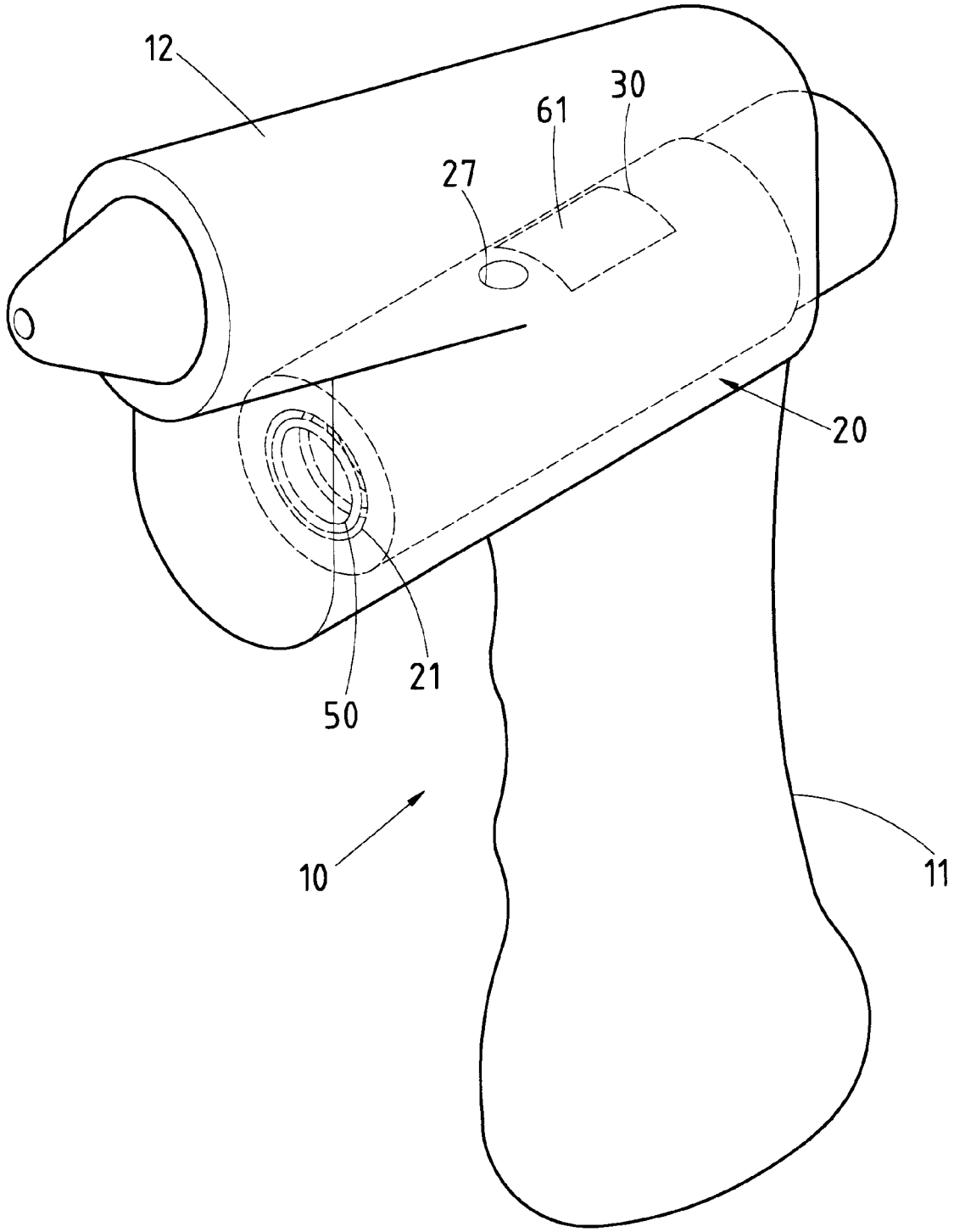
FIG. 3 shows a perspective view of the present invention.
Figure 4:
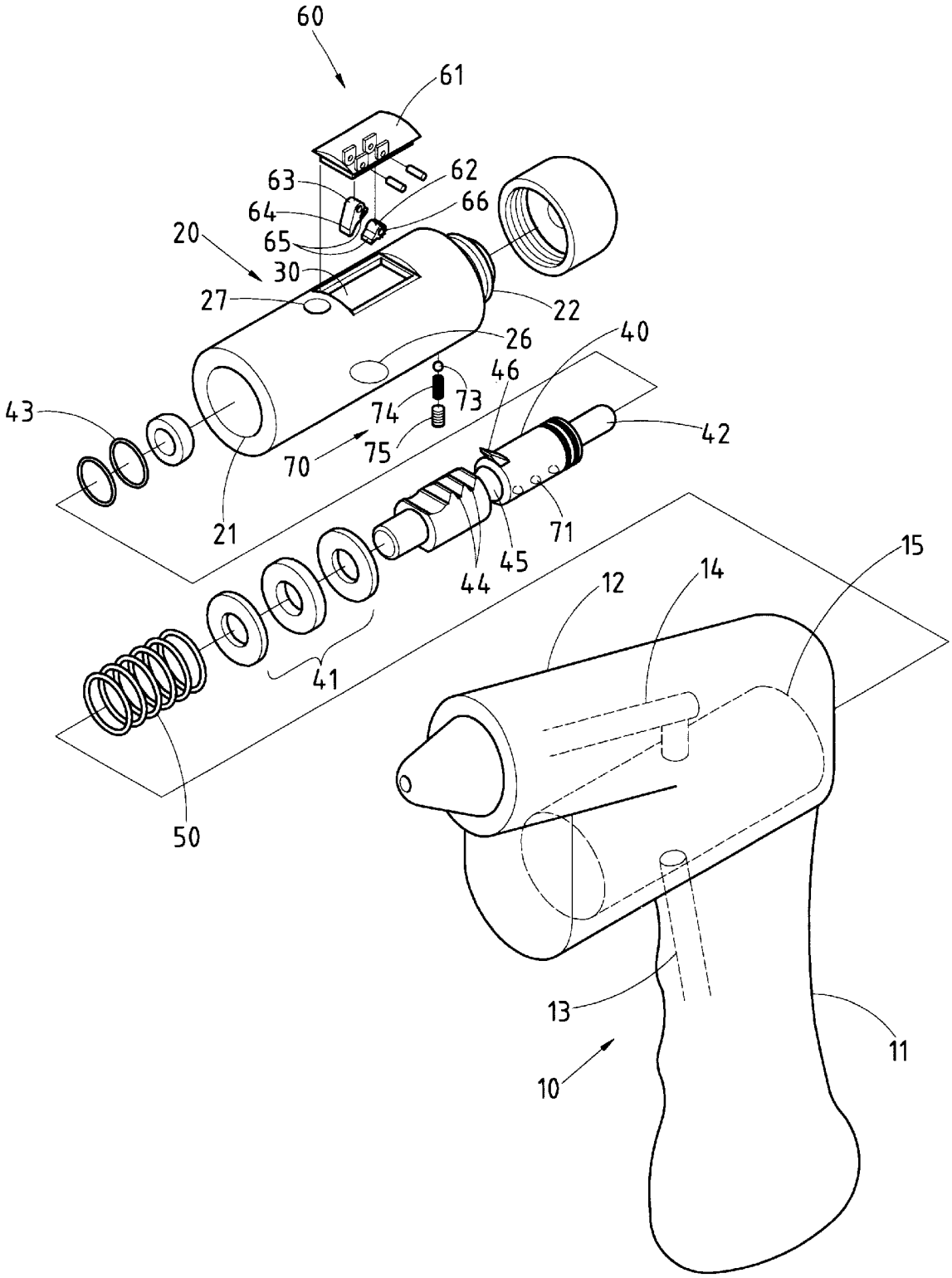
FIG. 4 shows an exploded schematic view of the present invention.

As shown in FIGS. 3–10, a pistol nozzle 10 embodied in the present invention comprises a handle 11 and a barrel 12. The handle 11 is provided in the interior with a water admitting channel 13, whereas the barrel 12 is provided in the interior with a water discharging channel 14. Located at the juncture of the water admitting channel 13 and the water discharging channel 14 is a receiving slot 15 in which a water control device is disposed.

The water control device is formed of a base tube 20, a valve rod 40, a recovery element 50, a retaining member 60, and a locating member 70.

The base tube 20 is located in the receiving slot 15 and is provided with an open end 21, a closed end 22, and a stop edge 23 located in the hollow interior of the base tube 20 such that the hollow interior is divided by the stop edge 23 into a first chamber 24 and a second chamber 25. The base tube 20 is further provided with a water admitting hole 26 corresponding in location to the water admitting channel 13, and with a water discharging hole 27 corresponding in location to the water discharging channel 14. The second chamber 25 is provided with a guide slot 28 which is in turn provided with a through hole 29 in communication with the closed end 22. The second chamber 25 is further provided in the side wall with an insertion slot 30.

The valve rod 40 is pivoted in the second chamber 25 such that an inner end of the valve rod 40 is extended into the first chamber 24. The inner end of the valve rod 40 is provided with a piston 41, which is located between the water admitting hole 26 and the water discharging hole 27. The valve rod 40 is further provided at an outer end thereof with a knob pillar 42, which is jutted out of the closed end 22 via the through hole 29. The outer segment of the valve rod 40 is slidably pivoted in the guide slot 28 and is provided with a washer 43. The valve rod 40 is further provided in the outer wall surface with one-way ratchet slots 44, an urging projection 46, and a recess 45 located between the ratchet slots 44 and the urging projection 46.

The recovery element 50 has one end urging the piston 41 of the valve rod 401 and other end urging the inner wall of the receiving slot 15. The recovery element 50 serves to provide a recovery force enabling the valve rod 40 to slide toward an outer end of the barrel 12 of the pistol nozzle 10.

Figure 5:
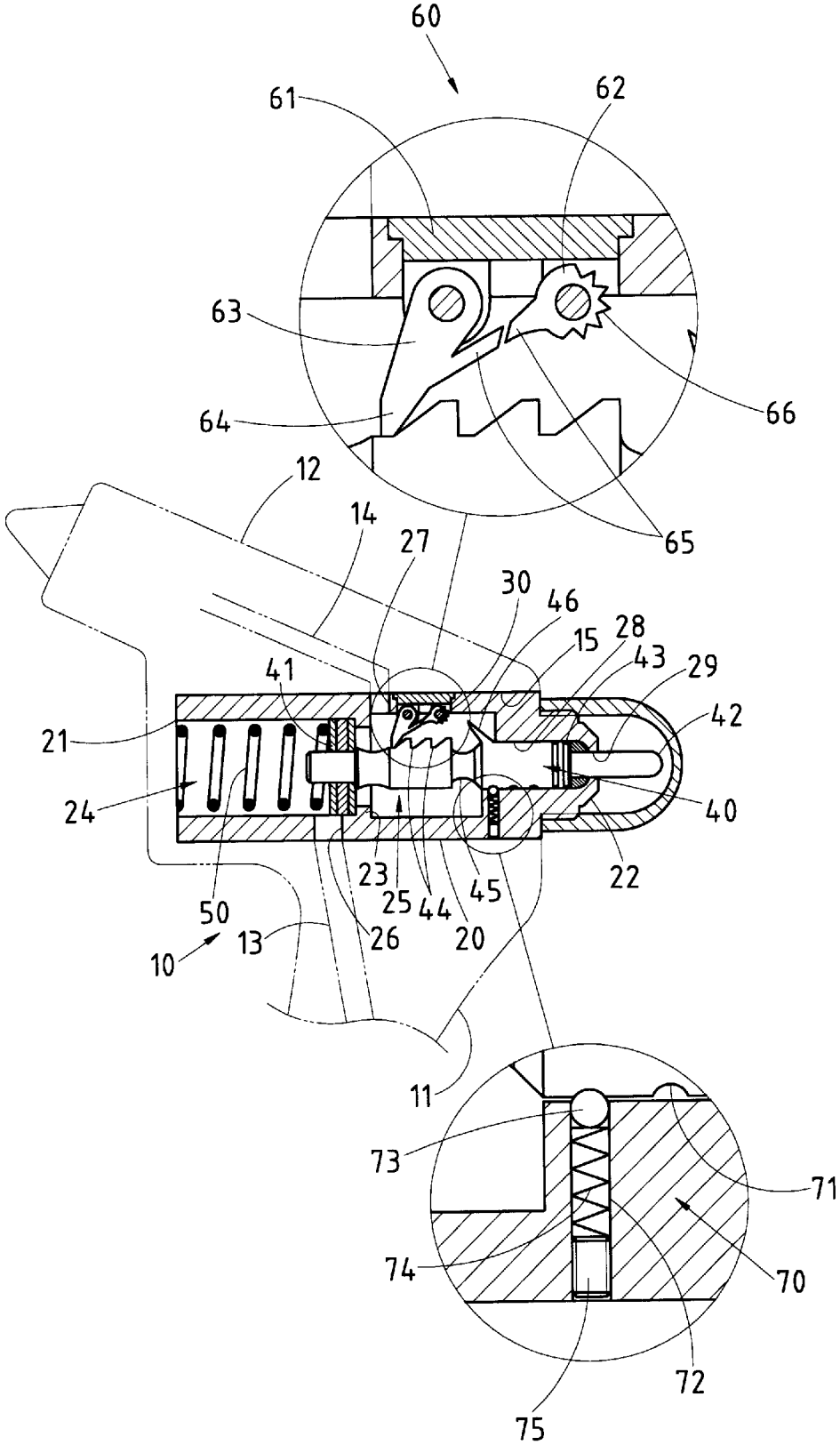
FIG. 5 shows a sectional view of the present invention in combination.

The retaining member 60 is formed of a seat plate 61, a first transmission piece 62, and a second transmission piece 63. The first transmission piece 62, and a second transmission piece 63 are pivoted to the underside of the seat plate 61. The retaining member 60 is mounted on the seat tube 20 such that the retaining member 60 is corresponding in location to the ratchet slots 44 of the valve rod 40, and that the seat plate 61 is inserted into the insertion slot 30 of the second chamber 25 of the base tube 20. The second transmission piece 63 has an inclined stop portion 64 serving to prevent the valve rod 40 in motion from sliding backward in conjunction with the one-way ratchet slots 44. The first transmission piece 62 and the second transmission piece 63 are provided with a transmission portion 65, as shown in FIG. 5. The first transmission piece 62 is further provided with a serrated portion 66 opposite in location to the transmission portion 65. The serrated portion 66 is pushed by the urging projection 46 of the valve rod 40 such that the first transmission piece 62 is actuated to turn, so as to actuate the inclined stop portion 64 of the second transmission piece 63 to turn.

The locating member 70 is provided with a plurality of locating portions 71, which are arranged at an interval corresponding to the interval of the ratchet slots 44 of the valve rod 40. The locating member 170 is further provided with a slot 72 in which a ball 33, a position confining body 75, and a spring 74 are disposed such that the spring 74 is located between the ball 73 and the position confining body 75, as shown in FIG. 5. As the valve rod 40 slides, the ball 73 is located by the locating portions 71.

As shown in FIG. 5, the valve rod 40 is pushed by the recovery element 50 to slide toward the outer side such that the piston 41 is stopped by the stop edge 23 of the base tube 20, thereby resulting in separation of the water admitting hole 26 from the water discharging hole 27.

Figure 6:
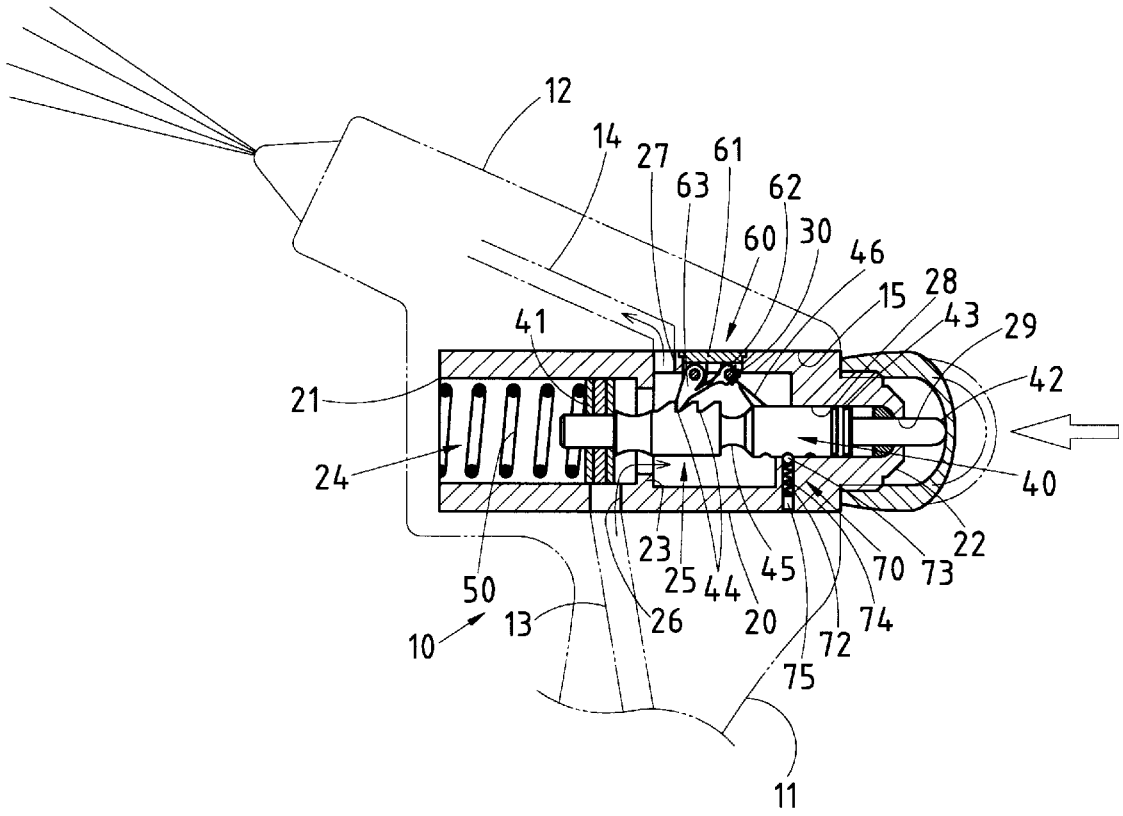
FIGS. 6–10 are schematic views of the present invention in action.
Figure 7:
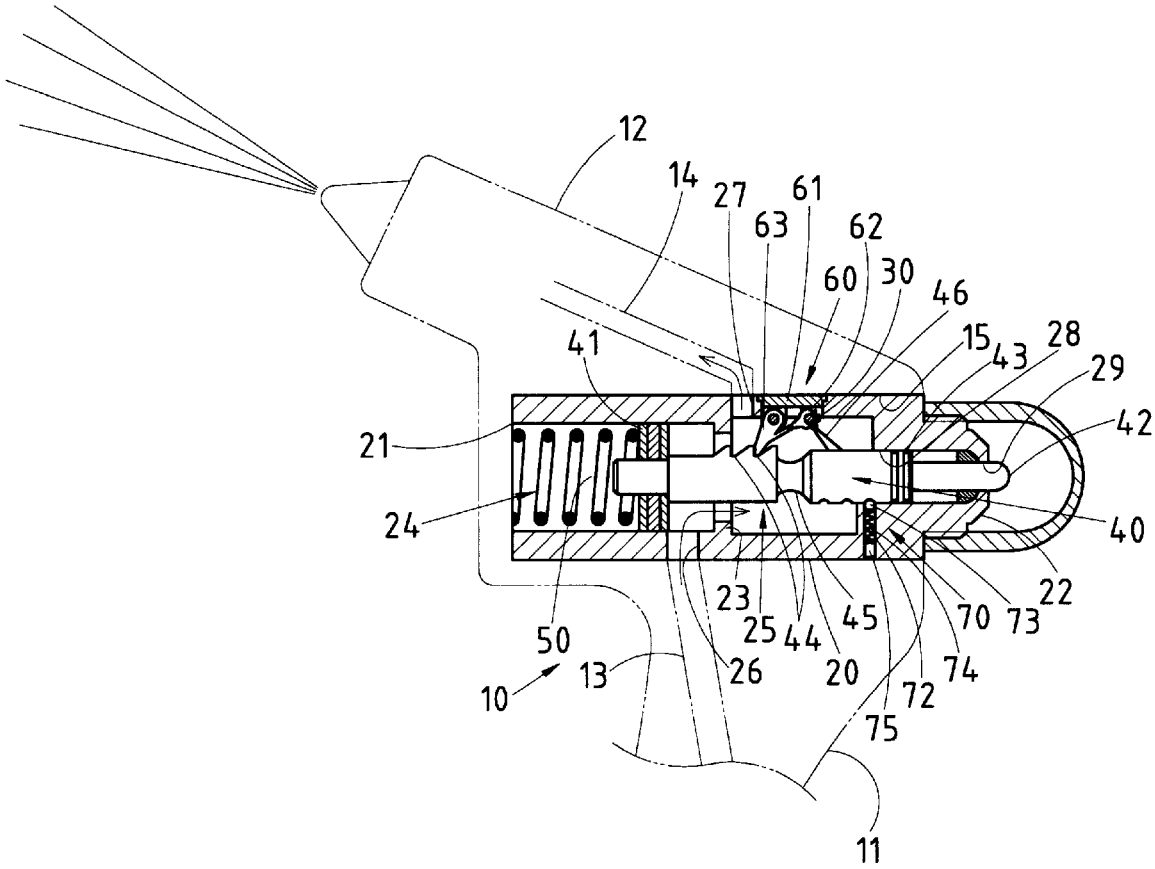

As shown in FIG. 6, when the knob pillar 42 of the valve rod 40 is exerted on by an external force, the valve rod 40 is pushed to slide toward the inner side such that the stop portion 64 of the second transmission piece 63 is retained in sequence by the one-way ratchet slots 44, and that the ball 73 of the locating member 70 is located by the locating portions 71 of the locating member 70, thereby preventing the valve rod 40 from moving backward and causing the piston 41 to block partially the water admitting hole 26 of the base tube 20, as shown in FIG. 7. The water flow can be thus controlled by the piston 41 of the valve rod 40, depending on the extent to which the water admitting hole 26 of the base tube 20 is blocked by the piston 41.

Figure 8:
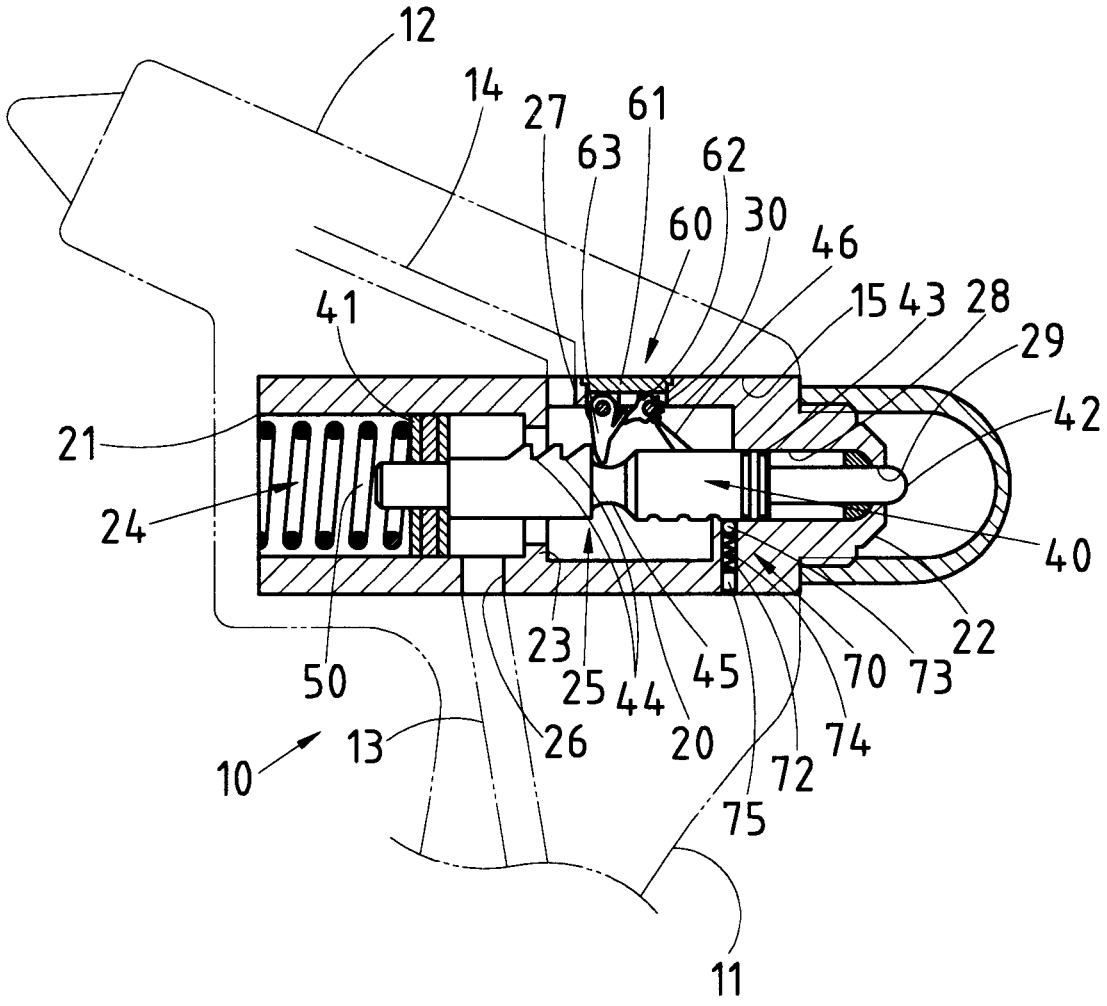
Figure 9:
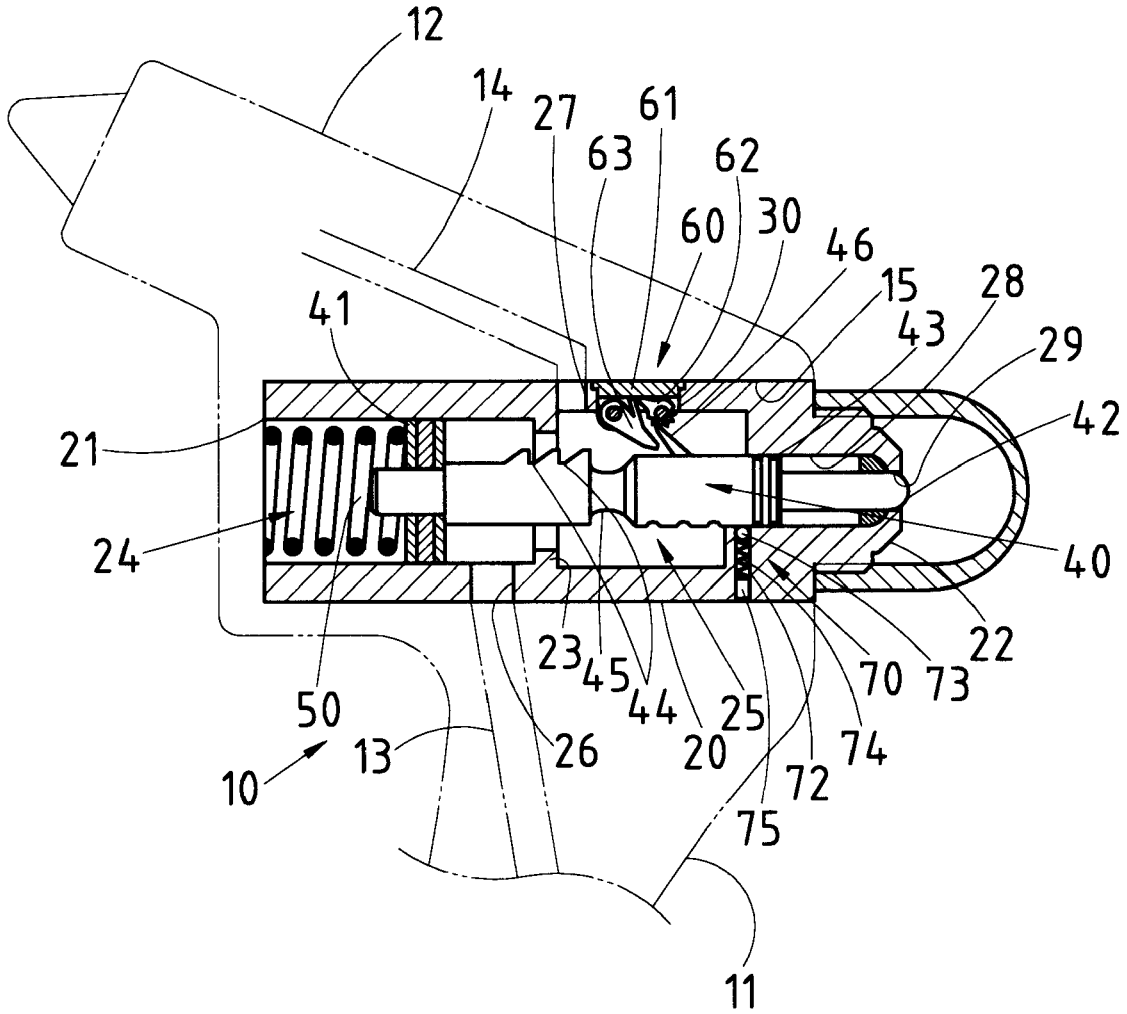
Figure 10:
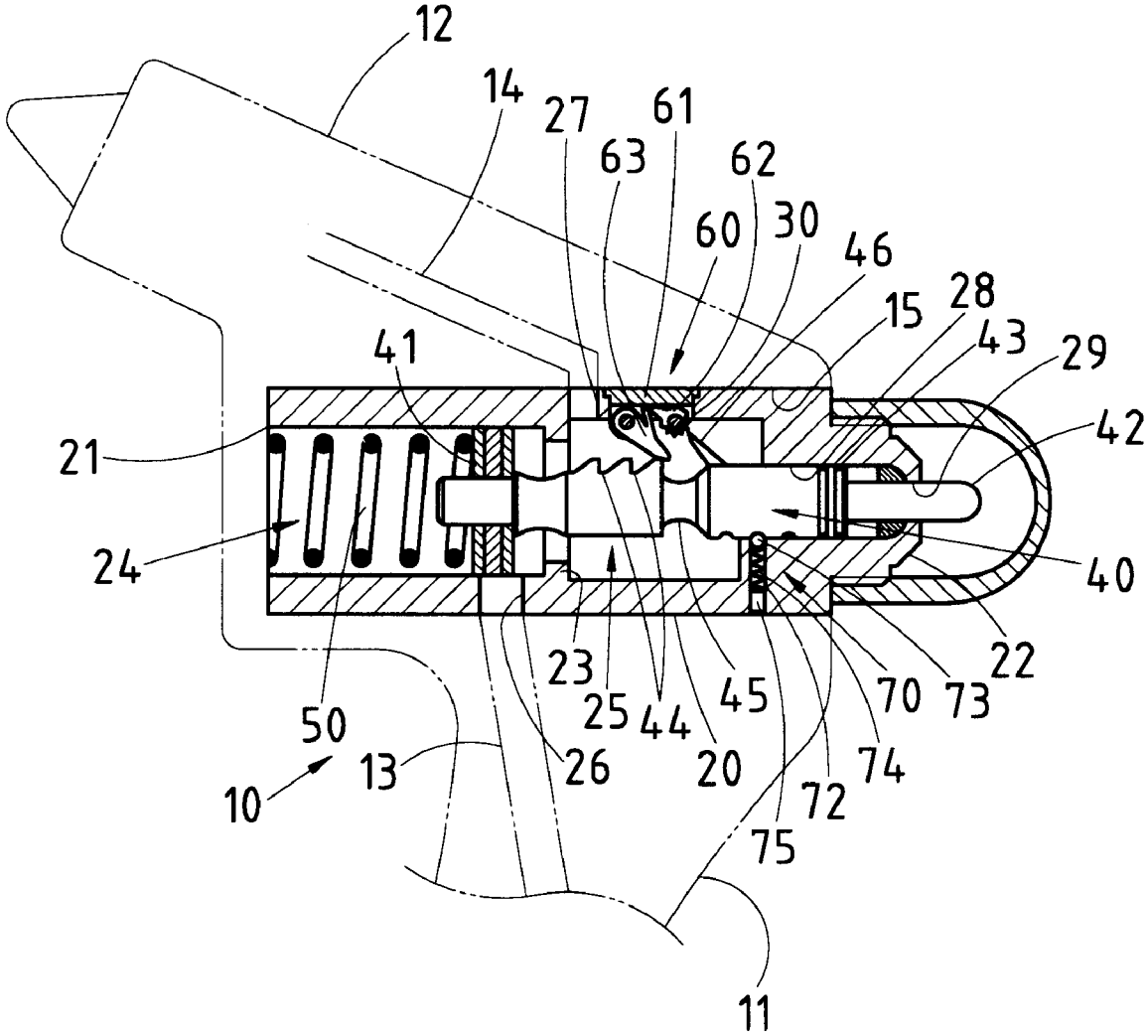
Figure 11:
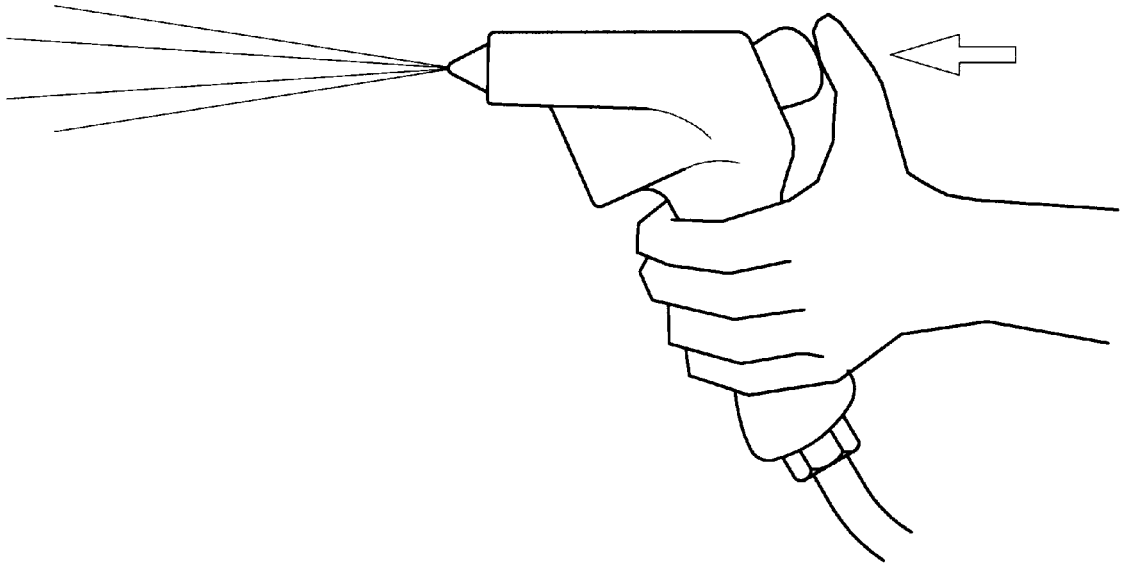
FIG. 11 shows a schematic view of the present invention in use.

As illustrated in FIGS. 8 and 9, the water flow can be completed stopped by causing the valve rod 40 to slide back to its original position. The valve rod 40 is pushed to enable the stop portion 64 of the second transmission piece 63 to move through the ratchet slots 44 to stay in the recess 45 of the valve rod 40. As the valve rod 40 is pushed to a predetermined stop position, the serrated portion 66 of the first transmission piece 62 is pushed by the urging projection 46 of the valve rod 40, so as to actuate the first transmission piece 62 to turn. As a result, the transmission portion 65 actuates the stop portion 64 of the second transmission piece 63 to remain in the disengagement statel as shown in FIG. 9. As the knob pillar 42 is relieved of the pressure of the external force, the valve rod 40 is forced by the recovery force of the recovery element 50 to move back to its original position. In the meantime, the second transmission piece 63 is incapable of engaging the ratchet slots 44, as shown in FIG. 10. The valve rod 40 is returned to its original position as shown in FIG. 5. It must be noted here that the recovery element 50 is greater in spring force than the spring 74 of the locating member 70.

I claim:

1. A pistol nozzle of lawn sprinkler comprising:

a handle comprised of, in an interior, a water admitting channel;

a barrel connected with the handle and comprised of, in an interior, a water discharging channel; and a water control device disposed in a receiving slot which is located at the juncture of the water admitting channel of the handle and the water discharging channel of the barrel; wherein said water control device comprises:

a base tube comprising an open end, a closed end, and a stop edge located in a hollow interior thereof such that said hollow interior is divided by said stop edge into a first chamber, and a second chamber which is comprised of an insertion slot, and a guide slot, said guide slot being comprised of a through hole in communication with said closed end, said base tube further comprised of a water admitting hole corresponding in location to said water admitting channel of the handle, said base tube further provided with a water discharging hole corresponding in location to said water discharging channel of the barrel;

a valve rod pivoted in said second chamber of said base tube such that an inner end of said valve rod is extended into said first chamber of said base tube, said inner end of said valve rod being comprised of a piston which is located between said water admitting hole and said water discharging hole of said base tube, said valve rod further provided at an outer end thereof with a knob pillar, said knob pillar jutting out of said closed end of said base tube via said through hole of said guide slot of said second chamber of said base tube, said valve rod further comprising in an outer wall, a plurality of one-way ratchet slots, an urging projection, and a recess located between said ratchet slots and said urging projection;

a recovery element disposed in said base tube such that one end of said recovery element urges said piston of said valve rod, and that another end of said recovery element urges an inner wall of said receiving slot, said recovery element serving to provide said valve rod with a force enabling said valve rod to slide toward an outer end of the barrel of the pistol nozzle;

a retaining member comprised of a seat plate, a first transmission piece, and a second transmission piece, with said first transmission piece and said second transmission piece being pivoted to an underside of said seat plate, said retaining member being mounted on said base tube such that said seat plate is inserted into said insertion slot of said base tube, and that said retaining member is corresponding in location to said ratchet slots of said valve rod, said second transmission piece having an inclined stop portion serving in conjunction with said ratchet slots to prevent said valve rod from sliding in a backward direction, said first transmission piece and said second transmission piece being provided respectively with a transmission portion enabling said first transmission piece in motion to actuate said second transmission piece to turn, said first transmission piece being further comprised of a serrated portion engageable with said urging projection of said valve rod; and a locating member comprising a plurality of locating portions which are arranged at an interval corresponding to an interval of said ratchet slots of said valve rod, said locating member further comprising a slot in which a ball, a position confining body, and a spring are disposed such that said spring is located between said ball and said position confining body whereby said ball is located by said locating portions at such time when said valve rod slides;

said water admitting hole of said base tube being completely blocked by said piston of said valve rod at such time when said valve rod is pushed by the force of said recovery element to slide such that said piston is stopped by said stop edge of said base tube;

said water admitting hole of said base tube being partially obstructed by said piston of said valve rod at such time when said knob pillar of said valve rod is being exerted on by an external force, thereby causing said stop portion of said second transmission piece to engage in sequence said ratchet slots of said valve rod, and causing said ball of said locating member to be located in sequence by said locating portions of said locating member, said partially-obstructed water admitting hole of said base tube being completely blocked once again by said piston of said valve rod at such time when said knob pillar of said valve rod is relieved of the external force exerting thereon, thereby causing said valve rod to slide such that said stop portion of said second transmission piece is located in said recess of said valve rod, and that said serrated portion of said first transmission piece is pushed by said urging portion of said valve rod so as to actuate said first transmission piece to turn, and that said second transmission piece is actuated to turn by said first transmission piece in motion so as to cause said stop portion of said second transmission piece to remain in a disengagement state disabling said stop portion of said second transmission piece to engage said ratchet slots of said valve rod.

* * * * *